US009199748B2

(12) United States Patent
Cremer

(10) Patent No.: US 9,199,748 B2
(45) Date of Patent: Dec. 1, 2015

(54) CONTINUOUS FILLING DEVICE

(75) Inventor: Fredius Johan Cremer, WS Noordwijkerhout (NL)

(73) Assignee: CREMER SPECIAALMACHINES B.V., LISSE (NL)

( * ) Notice: Subject to any disclaimer, the term of this patent is extended or adjusted under 35 U.S.C. 154(b) by 875 days.

(21) Appl. No.: 13/392,655

(22) PCT Filed: Aug. 24, 2010

(86) PCT No.: PCT/NL2010/050529

§ 371 (c)(1),
(2), (4) Date: May 3, 2012

(87) PCT Pub. No.: WO2011/028103

PCT Pub. Date: Mar. 10, 2011

(65) Prior Publication Data

US 2012/0311973 A1 Dec. 13, 2012

(30) Foreign Application Priority Data

Sep. 2, 2009 (NL) ..... 2003428

(51) Int. Cl.
*B65B 1/04* (2006.01)
*B65B 5/10* (2006.01)
(Continued)

(52) U.S. Cl.
CPC ..... *B65B 5/103* (2013.01); *B65B 39/145* (2013.01); *B65B 43/50* (2013.01); *B65B 43/60* (2013.01); *B65B 37/005* (2013.01)

(58) Field of Classification Search
CPC ..... B65B 5/103; B65B 5/101; B65B 43/50; B65B 43/60; B65B 39/145; B65B 39/14; B65B 39/12; B65B 39/003; B65B 39/00; B65B 39/007; B65B 35/30; B65B 35/58; B65B 9/045; B65B 35/06; B65B 35/12; B65B 35/32; B65B 1/06; B65B 57/20; B65B 37/02; B65B 37/16; B65B 65/08; B65B 65/07; B67C 7/0013; B67C 7/0006; B67C 7/004; B67C 7/00; B65G 47/846–47/848; A61J 1/03
USPC ..... 53/247, 473, 500, 235, 251, 253; 141/145, 166–168; 198/441, 450, 198/459.2, 480.1, 481.1, 608, 624; 221/105
See application file for complete search history.

(56) References Cited

U.S. PATENT DOCUMENTS 2,239,120 A 4/1941 Stewart et al.
2,540,120 A * 2/1951 Jacobs et al. ..... 53/510
(Continued)

FOREIGN PATENT DOCUMENTS

CN 2725170 Y 9/2005
WO 95/02539 A1 1/1995

OTHER PUBLICATIONS espacenet English abstract of CN 2725170Y.

*Primary Examiner* — Gloria R Weeks
*Assistant Examiner* — Justin Citrin
(74) *Attorney, Agent, or Firm* — Ladas & Parry LLP

(57) ABSTRACT

Filling device (1) for filling packagings with counted bulk goods, comprising a dispenser (74) having several dispensing units (33) provided with a counter for counted dispensation of the bulk goods to the packagings and a conveying device (73) for transport of the packagings with respect to the dispensing units, wherein the conveying device is provided with several consecutive transport wheels (5) and a transport wheel drive for mutual opposite rotation of the immediately consecutive transport wheels, wherein the transport wheels each have a first axis of rotation and several packaging holders spread around the circumference, wherein the transport wheels with the axes of rotation parallel to each other and at the location of the packaging holders (51) are positioned in each other's vicinity for the transfer of packagings between packaging holders at a mutual transfer position between the immediately consecutive transport wheels during the opposite rotation for obtaining a meandering conveyance path of the packagings with respect to the dispensing units, which path is constituted of opposite arch segments.

14 Claims, 10 Drawing Sheets

(51) Int. Cl.

| | |
|---|---|
| ***B65B 39/14*** | (2006.01) |
| ***B65B 43/50*** | (2006.01) |
| ***B65B 43/60*** | (2006.01) |
| *B65B 37/00* | (2006.01) |

(56) References Cited

U.S. PATENT DOCUMENTS

| | | | | | |
|---|---|---|---|---|---|
| 2,845,759 | A * | 8/1958 | Cote et al. | 53/495 | |
| 3,028,713 | A * | 4/1962 | Kennedy et al. | 53/251 | |
| 3,045,720 | A * | 7/1962 | Jungmayr et al. | 141/145 | |
| 3,611,658 | A * | 10/1971 | Dwyer | 53/131.5 | |
| 4,575,646 | A * | 3/1986 | Saneski | 326/29 | |
| 5,058,634 | A * | 10/1991 | Tisma | 141/129 | |
| 5,232,079 | A * | 8/1993 | Belcastro et al. | 198/370.11 | |
| 6,701,973 | B2 * | 3/2004 | Ikemoto | B65B 39/14 141/10 | |
| 2002/0108356 | A1 | 8/2002 | Aylward | | |
| 2008/0168815 | A1 * | 7/2008 | Coates | 72/4 | |
| 2009/0255948 | A1 * | 10/2009 | Bassani | 221/1 | |

* cited by examiner

CONTINUOUS FILLING DEVICE

RELATED APPLICATION INFORMATION

This application is a 371 of International Application PCT/NL2010/050529 filed 24 Aug. 2010 entitled "CONTINUOUS FILLING DEVICE", which was published in the English language on 10 Mar. 2011, with International Publication Number WO 2011/028103 A1, and which claims priority from Netherlands Patent Application 2003428, filed 2 Sep. 2009.

BACKGROUND OF THE INVENTION

The invention relates to a filling device for filling packagings with bulk goods, such as for instance pharmaceutical capsules or tablets in the pharmaceutical industry.

A known filling device for filling packagings with bulk goods comprises a conveyor for rectilinear transport of the packagings and a dispenser having several dispensing units that are each provided with a counter positioned above the conveyor for simultaneously dispensing counted bulk goods to several transported packagings. During dispensing the bulk goods the packagings stand still underneath the counters. The conveyor is adapted for keeping packagings ready between the counters as well, which packagings are to be filled in a next counting session.

While the transport comes to a standstill and gets into motion again, thrusting forces are exerted on the packagings, as a result of which they may topple down or the bulk goods loosely accommodated therein may get damaged. The filled packagings also make starts and stops when the packagings kept ready are placed underneath the counters. The number of superfluous starts and stops increases as the filling device is expanded with several dispensers to achieve an intended discharge volume of filled packagings.

It is an object of the invention to provide a filling device for filling packagings with bulk goods which provides an efficient way of filling the packagings.

It is an object of the invention to provide a filling device for filling packagings with bulk goods of which the intended discharge volume of filled packagings can be adapted with little effect on the integrity of the bulk goods in the packagings.

SUMMARY OF THE INVENTION

According to a first aspect, the invention provides a filling device for filling packagings with counted bulk goods, comprising a dispenser having several dispensing units provided with a counter for counted dispensation of the bulk goods to the packagings and a conveying device for transport of the packagings with respect to the dispensing units, wherein the conveying device is provided with several consecutive transport wheels and a transport wheel drive for mutual opposite rotation of the immediately consecutive transport wheels, wherein the transport wheels each have a first axis of rotation and several packaging holders spread around the circumference, wherein the transport wheels with the axes of rotation parallel to each other and at the location of the packaging holders are positioned in each other's vicinity for the transfer of packagings between packaging holders at a mutual transfer position between the immediately consecutive transport wheels during the opposite rotation for obtaining a meandering conveyance path of the packagings with respect to the dispensing units, which path is constituted of opposite arch segments.

The conveying device provides a meandering path in which the packagings can remain continuously and evenly in motion. The number of dispensing units can as a result be adjusted to the intended discharge volume of the filling device while the effect on the integrity of the counted bulk goods in the packagings remains the same.

In one embodiment consecutive transfer positions between consecutive transport wheels are situated on a first straight line. In an as regards structure advantageous manner, said dispensing units can also be positioned according to a parallel straight line.

In one embodiment the first axes of rotation of consecutive transport wheels are situated on a second straight line, so that the transport wheel drive can remain simple as regards structure.

In one embodiment the first line and the second line coincide with each other, as a result of which the opposite arch segments of the meandering conveyance path can have substantially the same length.

In one embodiment the first axes of rotation are substantially vertically oriented and the meandering conveyance path extends in a substantially horizontal straight plane, as a result of which accelerations of the packagings and the bulk goods in vertical direction can be counteracted.

In one embodiment the meandering conveyance path is constituted of opposite segments of an arc of a circle, as a result of which the centrifugal forces on the packagings and the bulk goods can remain constant to a large extent.

In one embodiment the meandering conveyance path is constituted of opposite substantially half arcs of a circle.

In one embodiment the packaging holders coming together at the transfer position enclose a packaging on both sides, so that the packaging toppling over specifically during the transfer between the transport wheels can be counteracted.

In one embodiment the transport wheels have an outer circumference situated on a circle at which outer circumference the packaging holders are situated.

In one embodiment thereof the packaging holders are adapted for at least partially enclosing the packagings within the outer circumference of the transport wheels.

In one embodiment the packaging holders are adapted for partially keeping the packagings outside of the outer circumference, so that already prior to the transfer they are ready to be engaged.

In one embodiment at the location of the transfer position the conveying device is provided with a first guide for imposing the transfer of a packaging at the transfer position between packaging holders of the consecutive transport wheels, which holders come together at the transfer position. The transfer can then take place reliably, as a result of which it is counteracted that the transferring packaging holder remains occupied.

In one embodiment the conveying device comprises a second guide between consecutive transfer positions for keeping the packagings confined in the packaging holders.

In one embodiment that can be properly cleaned by machine, the transport wheels are constituted of a circular bottom disc and a transport disc fixedly positioned above it, wherein the packaging holders are formed with recesses formed at the circumference of the transport disc and the portions of the bottom disc that are situated straight below the recesses.

The transport wheels can easily be removed, for instance to be cleaned, when the transport wheels are detachably magnetically connected to or magnetically locked with respect to the transport wheel drive.

In one embodiment the transport wheel drive comprises a transport wheel support having an electromagnet that can be switched on and off for connecting or locking the transport wheels with respect to the transport wheel drive. The connection or the locking can be effected and ended easily by switching the electromagnet on and off.

In one embodiment the transport wheel drive is adapted for synchronised opposite rotation of the immediately consecutive transport wheels at the same speed of revolution and per revolution with the same packaging holders at the transfer position, so that the transport process can be repeated infinitely for filling large quantities of packagings.

In one embodiment the conveying device is provided above at least a part of the transport wheels with a slide per transport wheel, which slide is positioned at a slant and has a second axis of rotation and a lower exit for the transfer of counted bulk goods from the dispensing units to the packagings, wherein the conveying device comprises a slide drive for mutual opposite rotation of the in accordance with the transport wheels immediately consecutive slides for with the lower exit following a packaging moving away from the transfer position, which packaging is in a packaging holder of said transport wheel. Filling the packagings can then take place during transport between consecutive transfer positions.

In an embodiment that is advantageous as regards structure, the first and second axes of rotation coincide with each other.

In one embodiment the slide drive is adapted for synchronised opposite rotation of the in accordance with the transport wheels immediately consecutive slides at the same speed of revolution and with the same starting position with respect to the transfer position. During transport the filling process of the packagings can then be repeated infinitely for filling large quantities of packagings.

In one embodiment the height of the lower exit of the slide is adjustable with respect to the packaging holders, so that packagings of various heights can be filled.

In one embodiment the conveying device at the location of one or several last transport wheels is provided with a separation device for removing disapproved packagings from the meandering path, so that only the appropriately filled packagings are transported onwards for further processing, such as applying unique labels per packaging.

According to a second aspect the invention provides a method for filling packagings with counted bulk goods using a filling device, wherein the filling device comprises a dispenser having several dispensing units provided with a counter for counted dispensation of the bulk goods to the packagings and a conveying device for transport of the packagings with respect to the dispensing units, wherein the conveying device is provided with several consecutive transport wheels and a transport wheel drive for mutual opposite rotation of the immediately consecutive transport wheels, wherein the transport wheels each have a first axis of rotation and an even number of packaging holders spread around the circumference, wherein the transport wheels with the axes of rotation parallel to each other and at the location of the packaging holders are positioned in each other's vicinity for the transfer of packagings between packaging holders at a mutual transfer position between the immediately consecutive transport wheels during the opposite rotation for obtaining a meandering conveyance path of the packagings with respect to the dispensing units, which path is constituted of opposite arch segments, wherein the transport wheel drive is adapted for synchronised opposite rotation of the immediately consecutive transport wheels at the same speed of revolution and per revolution with the same packaging holders at the transfer position, wherein the conveying device above at least a part of the transport wheels is provided with a slide per transport wheel, which slide is positioned at a slant and has a second axis of rotation and a lower exit for the transfer of counted bulk goods from the dispensing units to the packagings, wherein the conveying device comprises a slide drive for mutual opposite rotation of the in accordance with the transport wheels immediately consecutive slides for with the lower exit following a packaging moving away from the transfer position, which packaging is in a packaging holder of said transport wheel, wherein the slide drive is adapted for synchronised opposite rotation of the in accordance with the transport wheels immediately consecutive slides at the same speed of revolution and with the same starting position with respect to the transfer position, wherein the conveying device per dispensing unit comprises a transport wheel and a slide and consecutive transfer positions between consecutive transport wheels are situated on a first straight line, wherein the method comprises repeatedly entering a series of packagings in the packaging holders of the first transport wheel positioned below a slide at the location of the first straight line, wherein the series is built up from several sub series and the slides per sub series move along with a packaging holder so as to rotate away from the transfer position and the dispensing units dispense a counted dose of bulk goods, wherein the size and composition of the series in sub series depending on the number of packaging holders per transport wheel and depending on the number of transport wheels positioned below a slide is determined as follows:

i) the number of sub series within the repetitive series equals the number of transport wheels positioned below a slide divided by two.

ii) the overall number of packagings of the repetitive series equals the number of packaging holders per transport wheel multiplied by the number of transport wheels positioned below a slide divided by two.

iii) if the number of sub series is an even number and if the number of transport wheels positioned below a slide is an even number, then the sub series each consist of a number of packagings equaling the overall number of packagings minus the number of sub series within the series divided by the number of sub series within the series, wherein a number of packagings equaling the number of sub series within the repetitive series is added to the first sub series of the series.

iv) if the number of sub series is an odd number and if the resulting number of a division of the transport wheels positioned below a slide by the number of sub series within the series results in an integer, the sub series each consist of a number of packagings equaling the overall number of packagings minus the number of sub series within the repetitive series, overall divided by the number of sub series within the repetitive series, wherein the number of packagings equaling the number of sub series within the series is added to the first sub series of the series.

v) in all other cases the sub series each consist of a number of packagings equaling the overall number of packagings of the repetitive series divided by the number of sub series within the repetitive series.

The numbers of packagings in the consecutive sub series are chosen such that the packagings in the transfer positions after entering a sub series are empty and ready to be able to be filled with bulk goods that are supplied from the dispensing units via the slides.

In one embodiment the filling device comprises several exchange sets of identical transport wheels of which the number of packaging holders per transport wheel per set is different, wherein the method comprises prior to filling placing an exchange set in the conveying device and filling packagings according to the above-mentioned stipulations.

According to a third aspect the invention provides a filling device for filling packagings with counted bulk goods, comprising a dispenser having several dispensing units provided with a counter for counted dispensation of the bulk goods to the packagings and a conveying device for transport of the packagings with respect to the dispensing units, wherein the conveying device is provided with several consecutive transport wheels and a transport wheel drive for mutual opposite rotation of the immediately consecutive transport wheels, wherein the transport wheels each have a first axis of rotation and several packaging holders spread around the circumference, wherein the transport wheels are detachably magnetically or electromagnetically connected to or magnetically locked with respect to the transport wheel drive. The transport wheels are easily detachable for cleaning or exchange with other transport wheels.

In one embodiment the transport wheel drive comprises a transport wheel support having an electromagnet that can be switched on and off for connecting or locking the transport wheels with respect to the transport wheel drive. The connection or the locking can easily be effected and ended by switching the electromagnet on and off.

In an embodiment that is advantageous as regards structure, the transport wheel comprises a transport disc and a bottom disc that are integrally formed.

The aspects and measures described in this description and the claims of the application and/or shown in the drawings of this application may where possible also be used individually. Said individual aspects may be the subject of divisional patent applications relating thereto. This particularly applies to the measures and aspects that are described per se in the sub claims.

SHORT DESCRIPTION OF THE DRAWINGS

The invention will be elucidated on the basis of a number of exemplary embodiments shown in the attached schematic drawings, in which.

Figure 1:
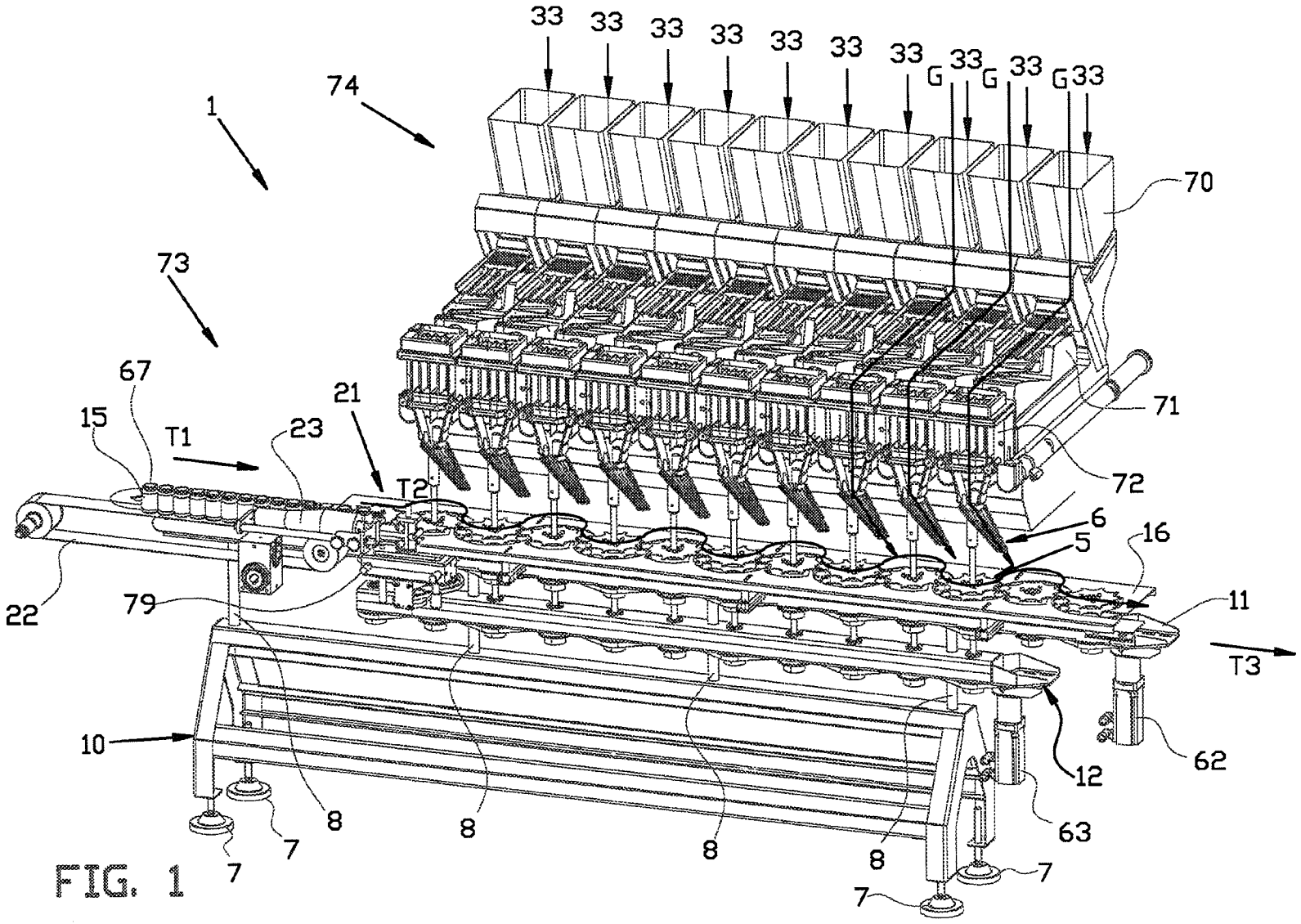
FIG. 1 shows an isometric view of a filling device according to the invention.
Figures 6A, 6B, 6C:
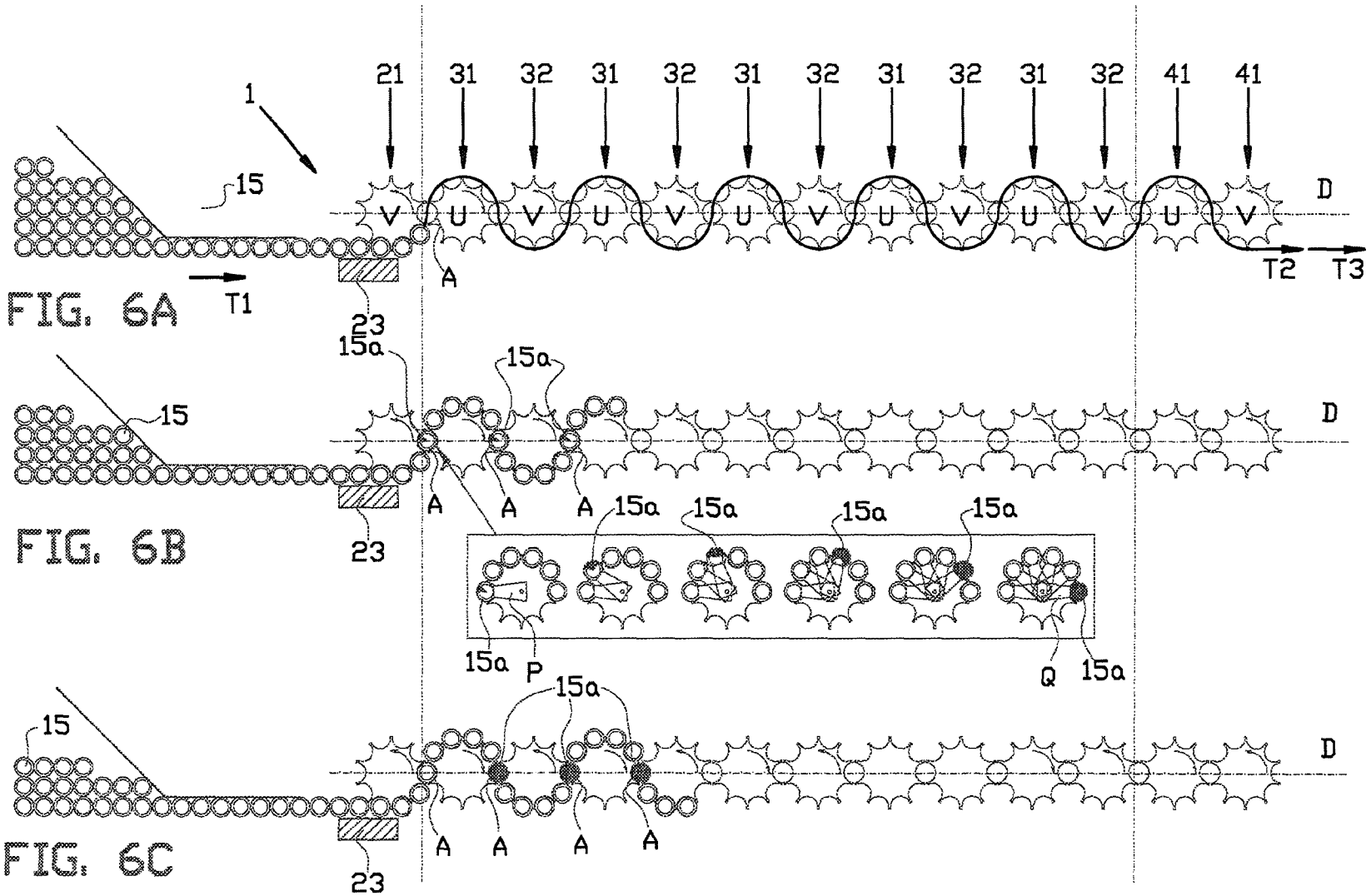
Figures 6D, 6E, 6F, 6G:
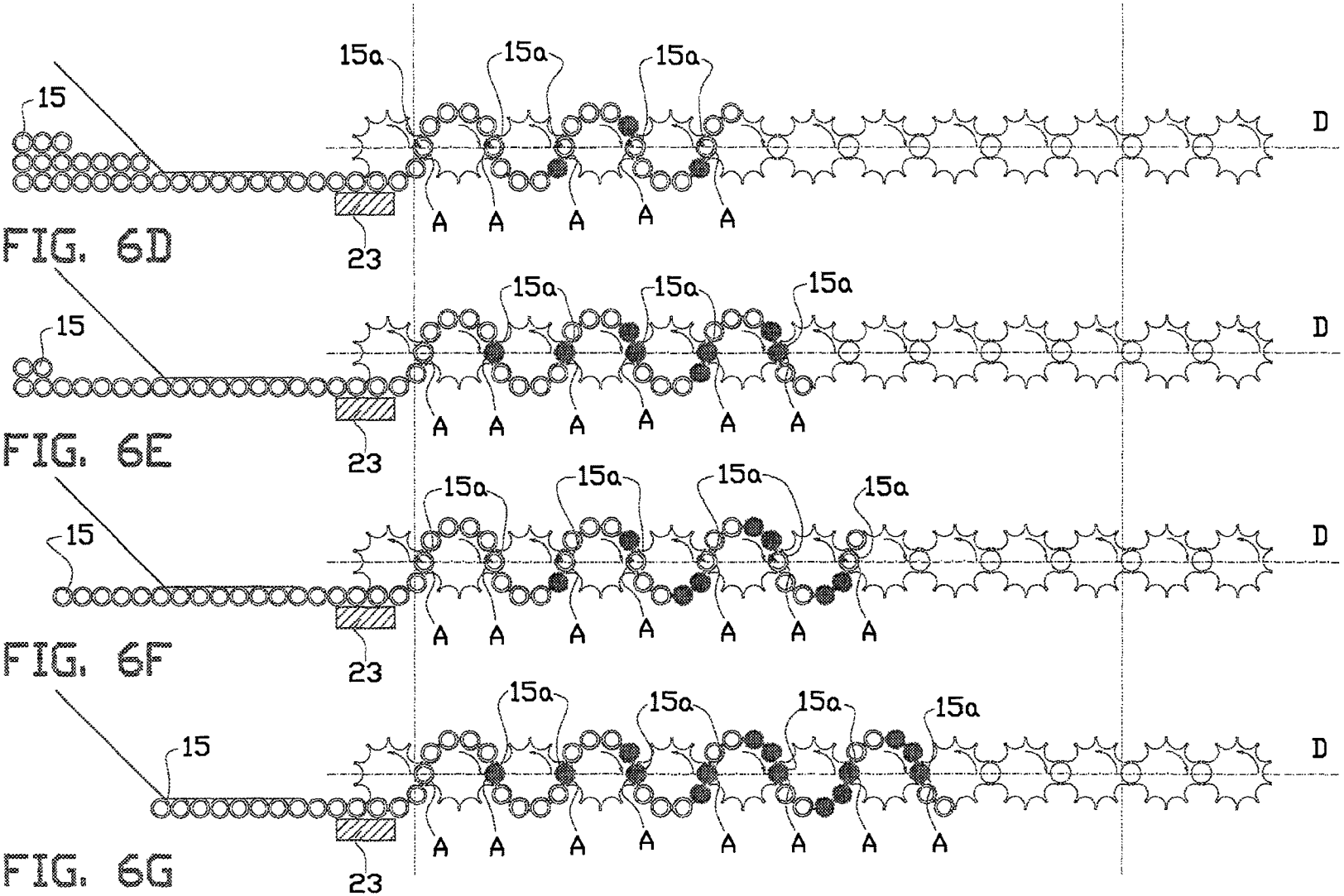
Figures 6H, 6I, 6J, 6K:
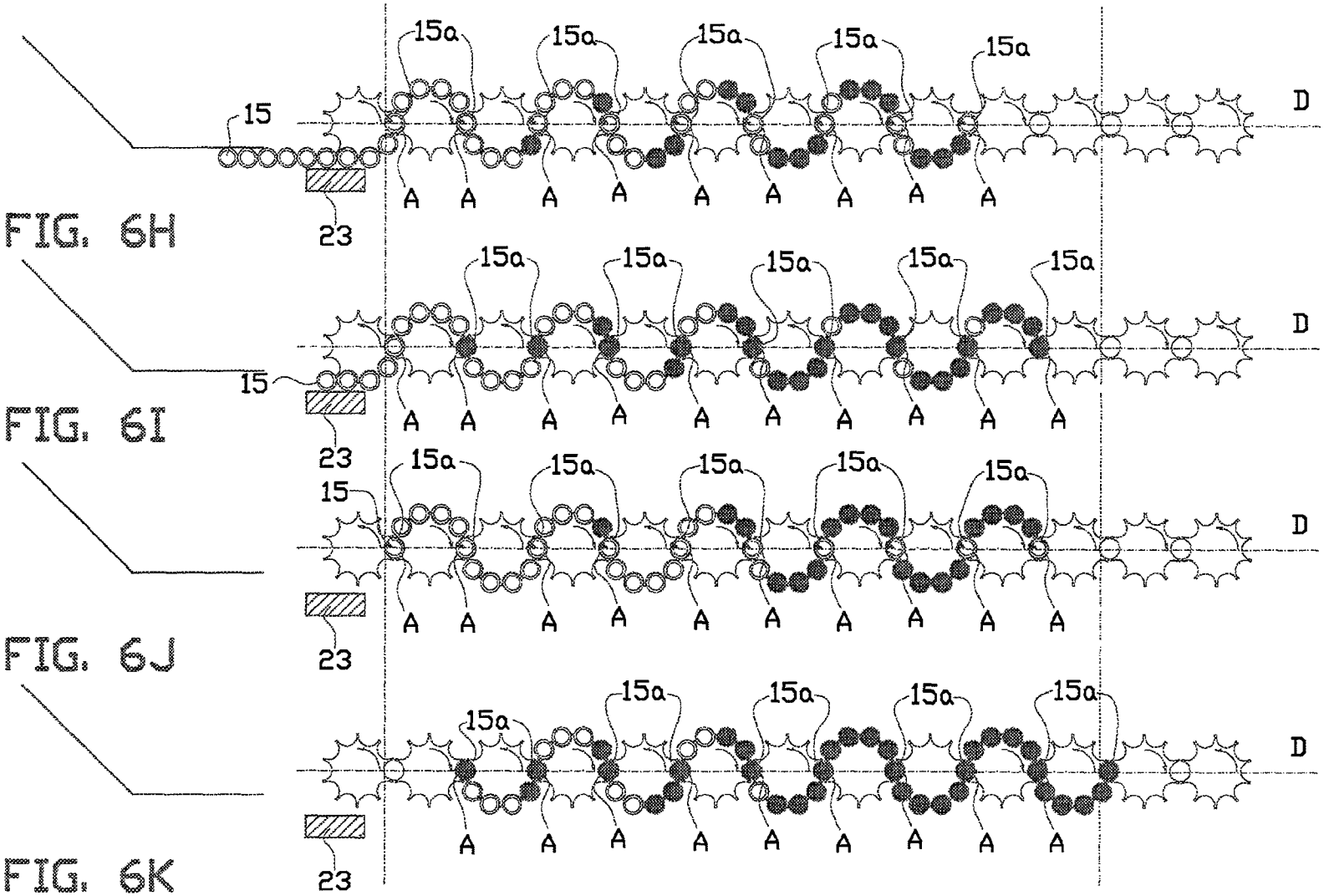
Figure 7A:
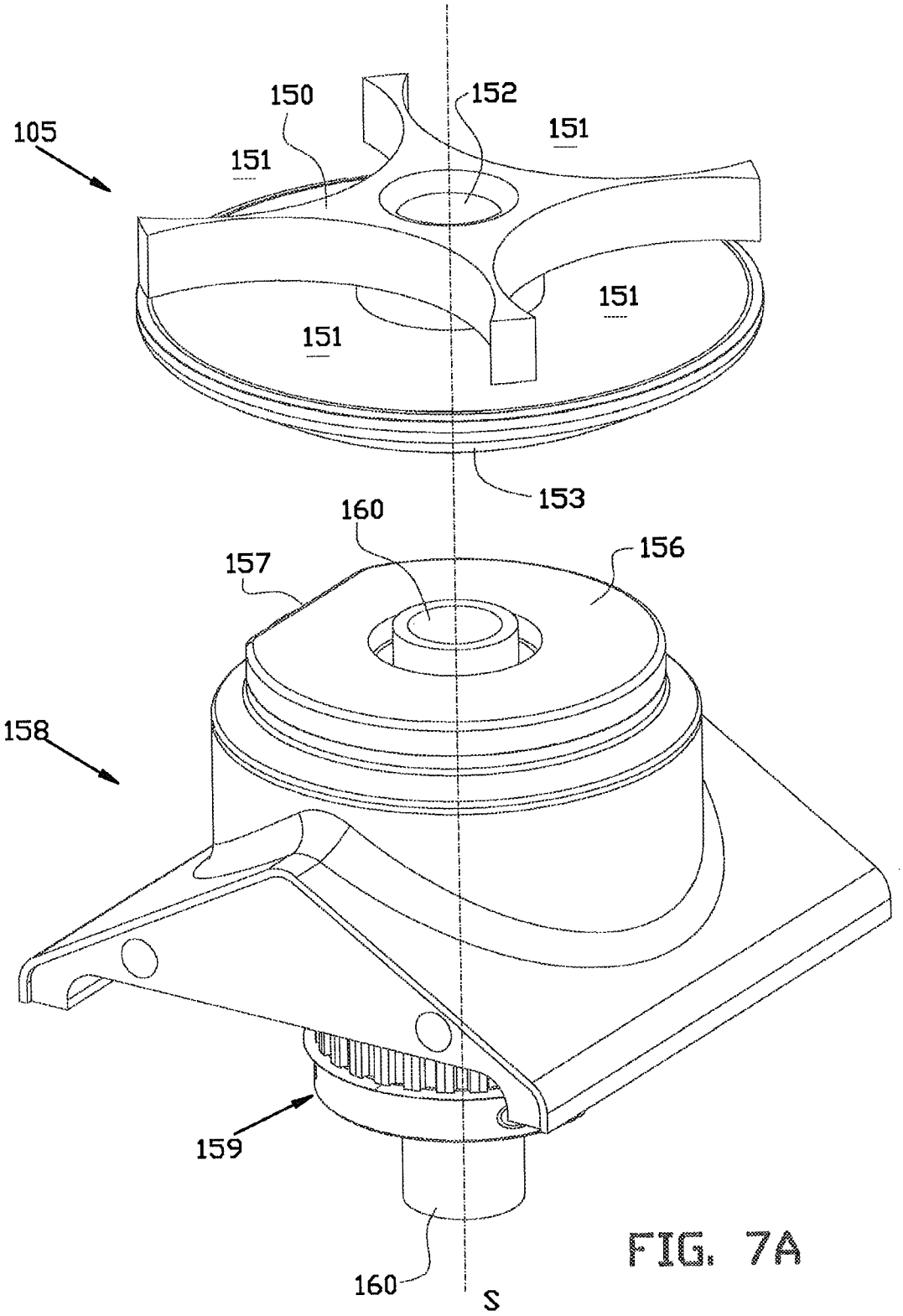
Figure 7B:
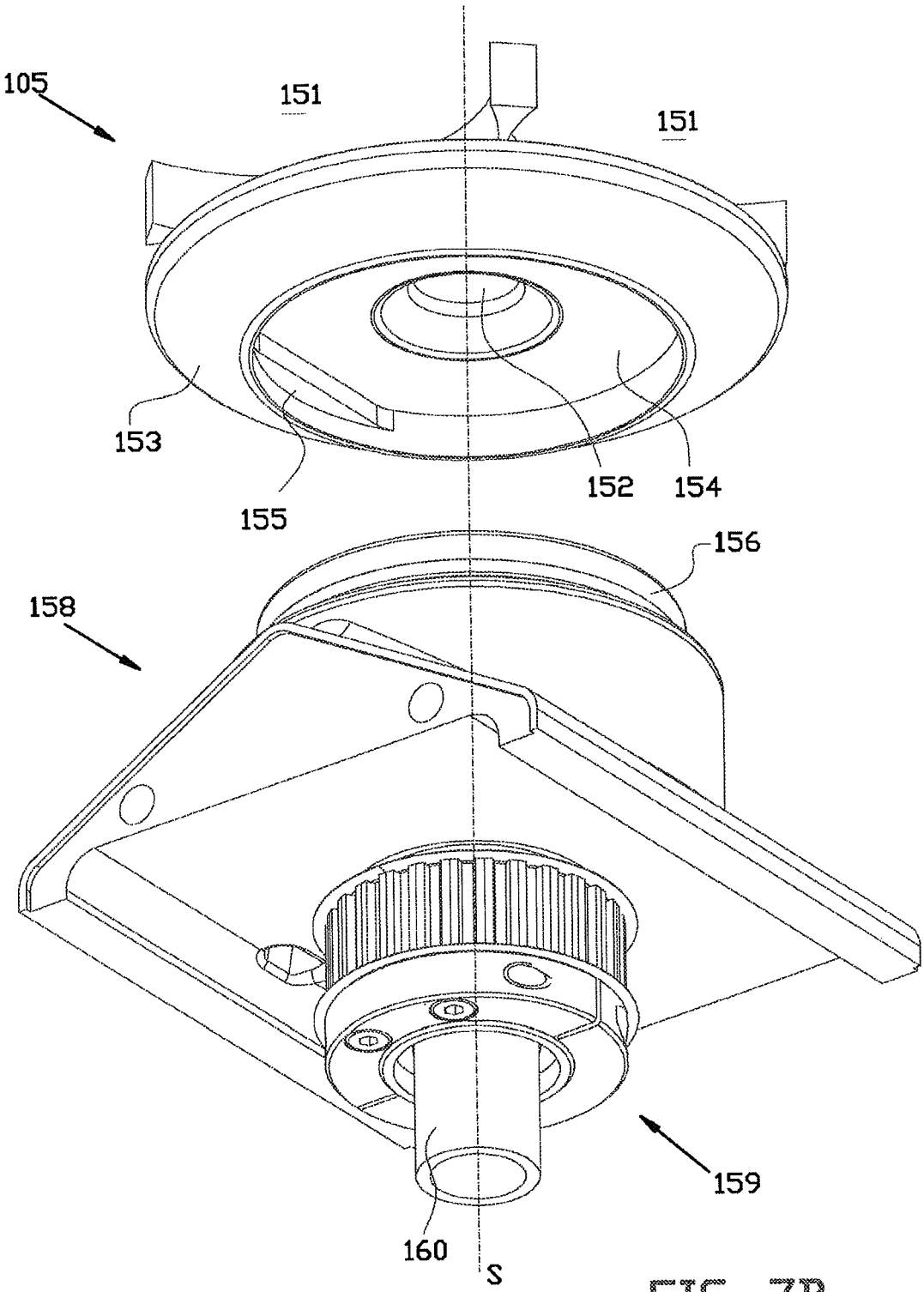

FIG. 6A-K show a schematic view of the operation of the filling device according to FIG. 1; and FIGS. 7A and 7B show isometric views of alternative parts for the filling device according to the invention.

DETAILED DESCRIPTION OF THE DRAWINGS

FIG. 1 shows a filling device 1 for filling packagings with bulk goods. In this example the packagings are pots 15 provided with a filling opening 67 which pots are filled from above with pharmaceutical tablets. The filling device 1 comprises a dispenser 74 and a conveying device 73 that will be discussed below in detail.

As shown in FIG. 1 the dispenser 74 in this example comprises ten adjacently positioned dispensing modules 33, each comprising a filling bunker 70, a vibration mechanism 71 for horizontally transporting the tablets out of the filling bunker 70 over vibrating troughs (not shown) and a counter 72 for counting and dispensing the tablets discharged by the vibrating troughs. The path of one tablet is schematically shown with arrow G.

Figure 2:
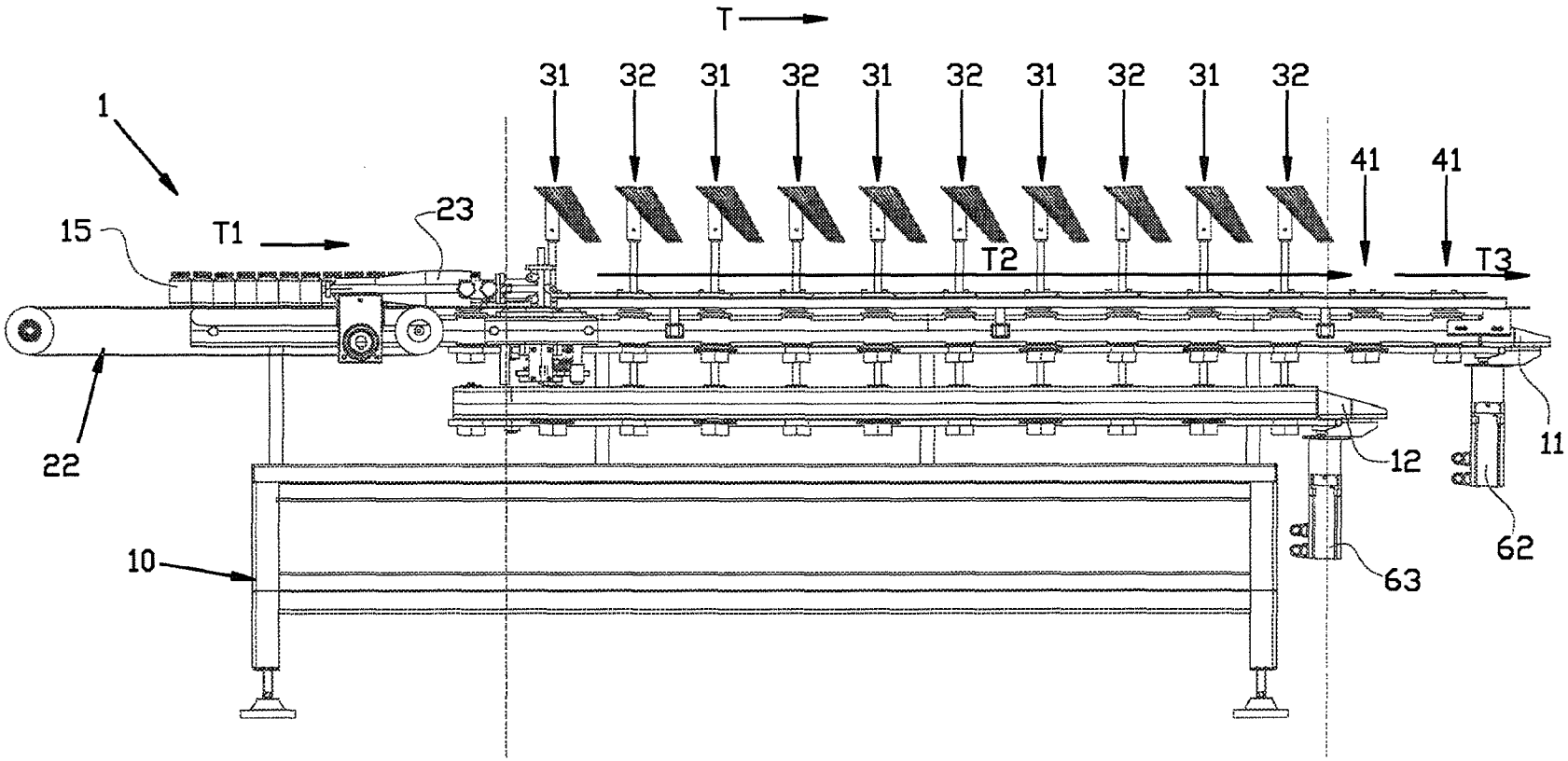
FIGS. 2 and 3 show a front view and a top view, respectively, of the filling device of FIG. 1.
Figure 3:
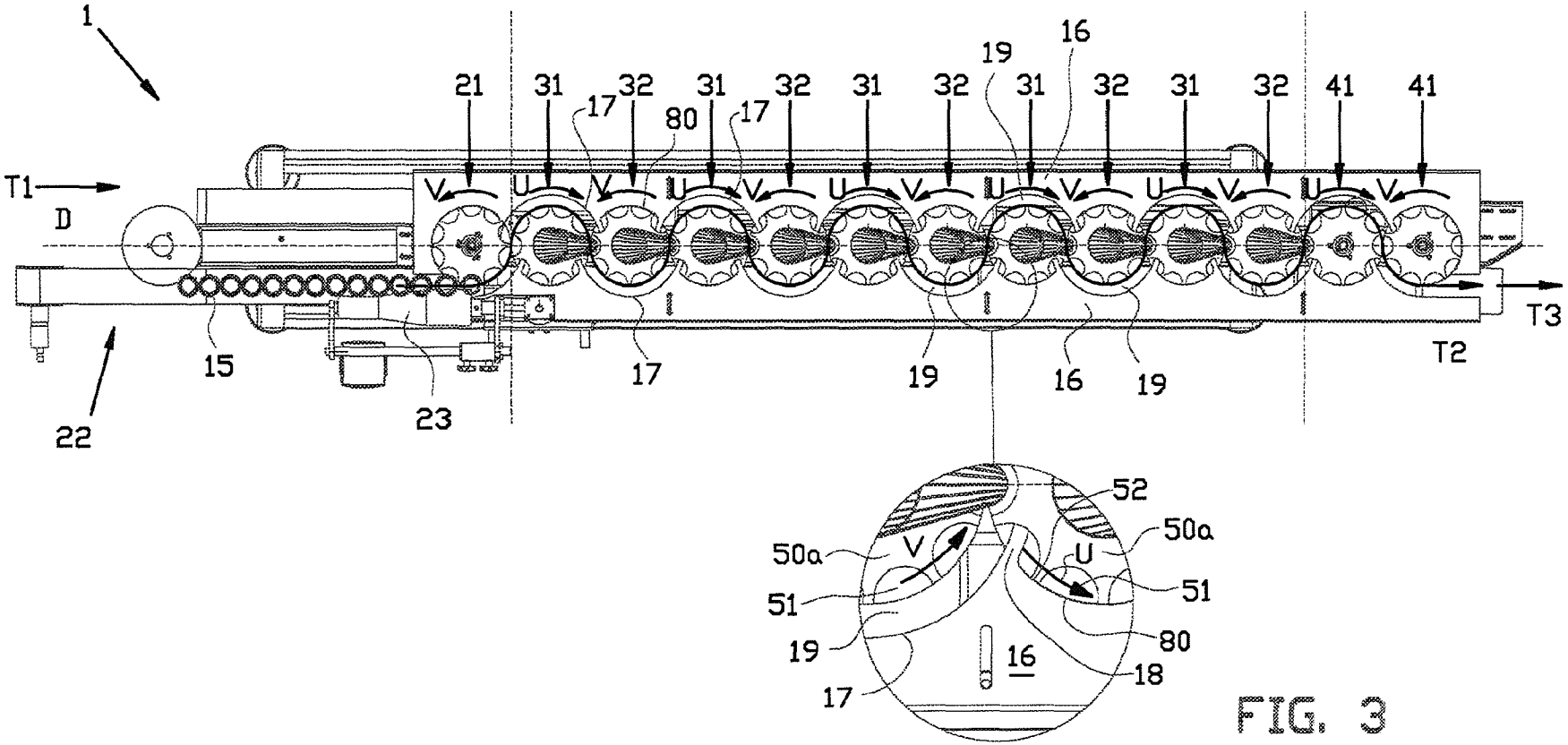
Figure 4:
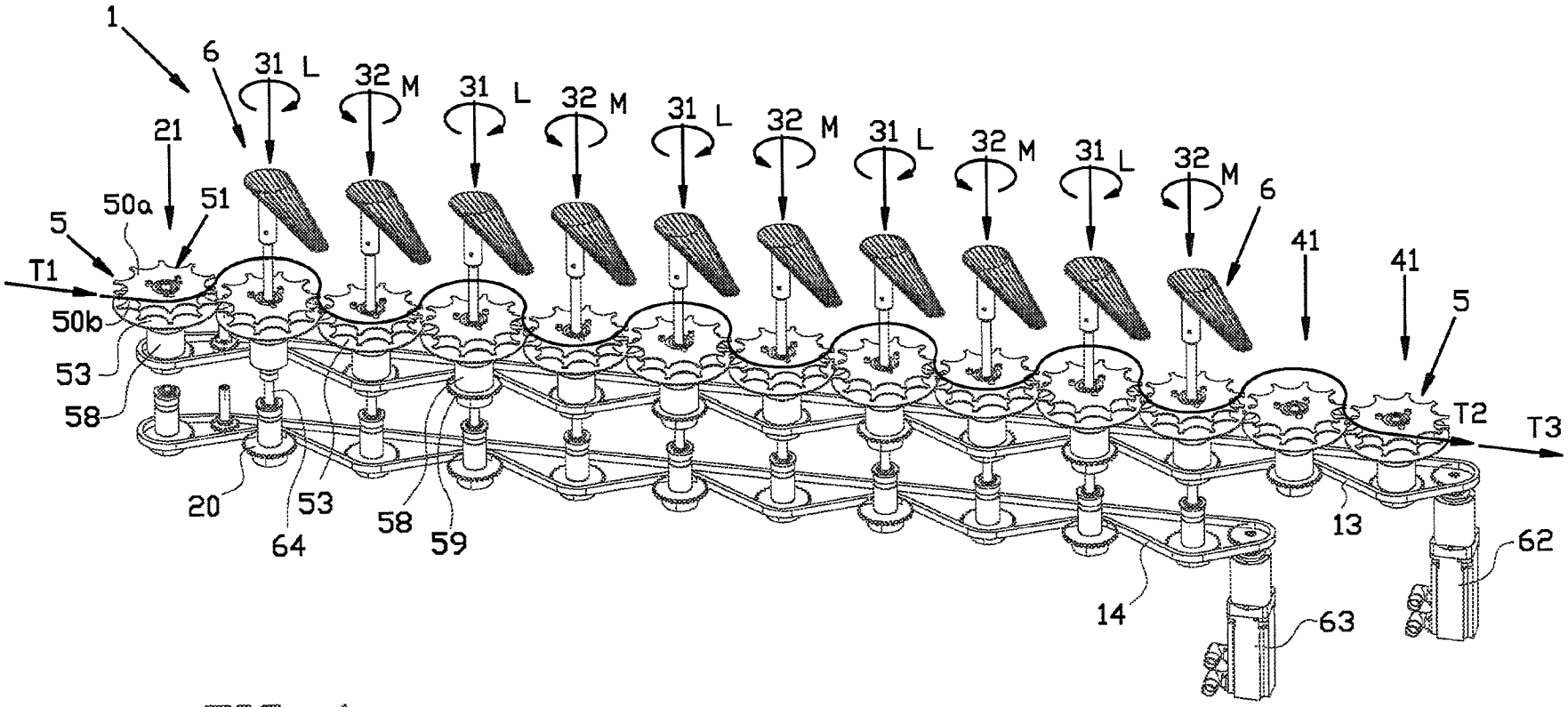
FIGS. 4 and 5 show isometric views of details of the filling device according to FIG. 1.
Figure 5:
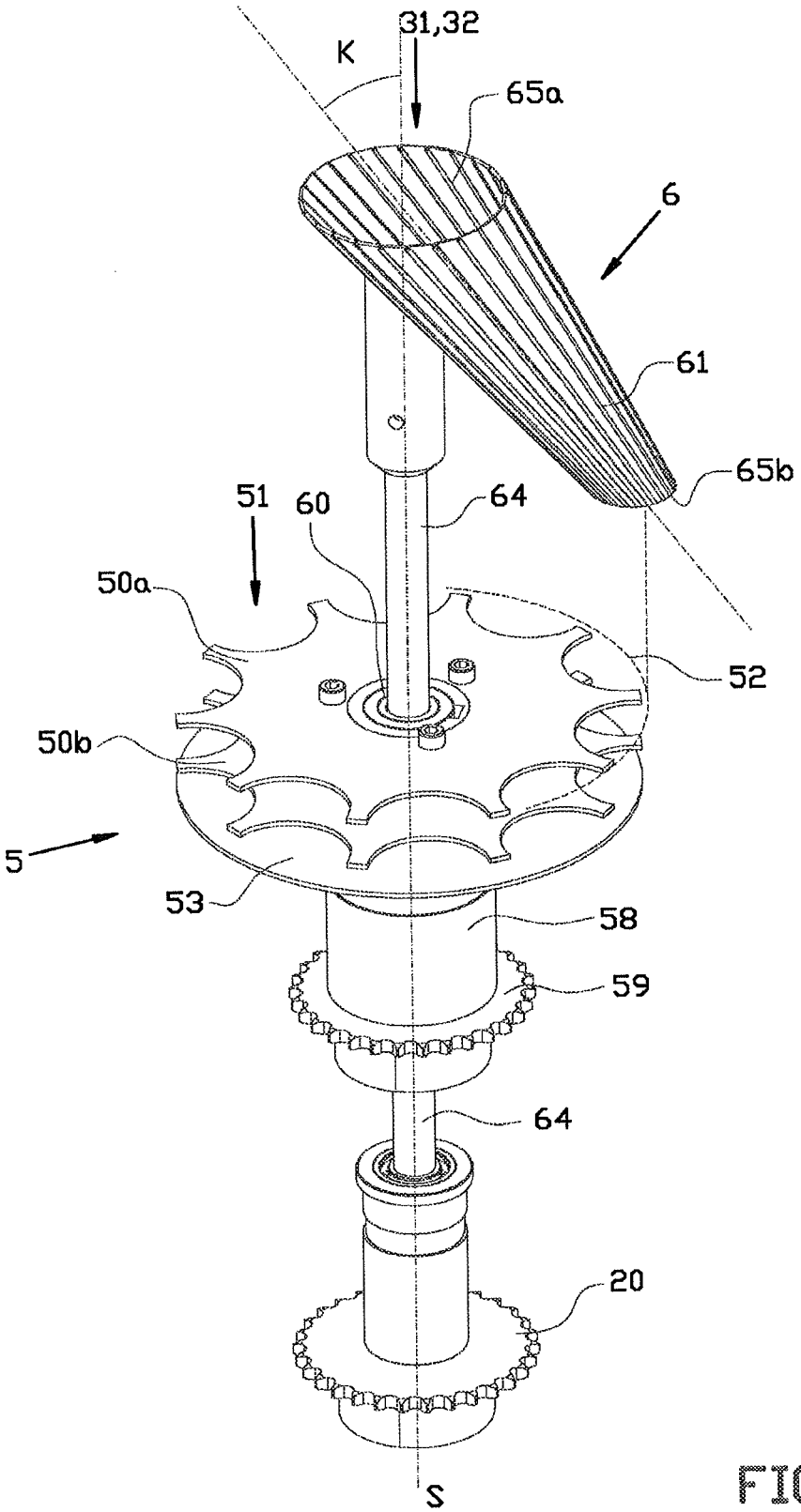

As shown in FIGS. 2 and 3 the conveying device 73 comprises an underframe 10, which is placed on a level basis by means of four legs 7 and an elongated first horizontal frame 11 that is fixedly connected to the underframe 10 by means of four vertical supports 8. As shown in FIGS. 3 and 4, the conveying device 73 according to a straight row is provided with one input conveyor 21, ten transit conveyors 31, 32 which are each positioned below a counter 72 of the dispensing modules 33, and two output conveyors 41. As shown in FIG. 5 said conveyors 21, 31, 32, 41 each comprise a first bearing housing 58 that is fixedly connected to the first frame 11, a hollow shaft 6D bearing mounted within the bearing housing 58, which hollow shaft has a vertical centre line and an axis of rotation S, a first toothed wheel 59 rotation-fixedly connected to the hollow shaft 60 at the lower side of the first bearing housing 58, and a transport wheel 5 rotation-fixedly connected to the hollow shaft 60 at the upper side of the first bearing housing 58. At equal intermediate distances, the axes of rotation S of the conveyors 21, 31, 32, 41 are in a straight line D straight below the counters 72.

As shown in FIG. 5 the transport wheels 5 are built up by means of two transport discs 50*a*, 50*b* and a circular bottom disc 53 that are positioned straight above one another and spaced apart from each other. The transport discs 50*a*, 50*b* and the bottom disc 53 have a circular outer contour of the same diameter. The transport discs 50*a*, 50*b* in this example are each provided with ten recesses recessed from the circumferential edge 52 and evenly spread around the circumferential edge 52 and having the shape of a part of a circle, forming an even number of packaging holders 51, wherein the packaging holders 51 of the transport discs 50*a*, 50*b* positioned above one another are straight above one another according to the vertical centre line S.

The shape and size of the packaging holders 51 is adjusted to the outer circumference of the pots 15. For different types of pots 15 exchange sets of alternative transport wheels are available, of which the packaging holders 51 as regards shape and number are adjusted to the various types of packagings.

As shown in FIG. 4 the conveying device 73 is provided with a first toothed belt 13 that alternately engages onto opposite sides of the first toothed wheels 59. At one outer end of the conveying device 73, the first toothed belt 13 is coupled to a transport wheel drive unit 62 that is adapted for letting the first toothed belt 13 circulate, as a result of which the consecutive transport wheels 5 acquire a first rotation direction U and an opposing second rotation direction V that are synchronised with each other. The transport wheels 5 are synchronised such with respect to each other that during rotation two packaging holders 51 on either side of every transport wheel 5 are straight across two packaging holders 51 of consecutive transport wheels 5. The packaging holders 51 at that moment together form several circular transfer positions A having a diameter that is suitable for confining pots 15, wherein the transfer positions A are straight above the straight line D.

As shown in FIG. 3 the conveying device 73 is provided with two flat horizontal guide plates 16 that extend parallel to the plane of the transport discs 50*a*, 50*b*, wherein the guide plates 16 together per conveyor 21, 31, 32, 41 at one side thereof comprise half a circularly curved guide edge 17 that is placed concentrically and spaced apart from the circumferential edge 52 of the discs 50*a*, 50*b*, wherein each circularly curved guide edge 17 is continued at the outer ends in a transfer guide edge 18 for guiding the pots 15 in and out during the transfer between two of the transport wheels 5. Between the guide edges 17 or across the guide edges 17, the guide plates 16 comprise transport disc confinement edges 80 that run parallel to the circumference of the transport discs

50*a*, 50*b*. The guide plates 16 in cooperation with the transport discs 50*a*, 50*b* thus bound a meandering guide channel 19. The guide channel 19 forms a meandering guide path T2 extending in the horizontal plane for guiding packagings 15 along the input, transit and output conveyors 21, 31, 32, 41.

As shown in FIGS. 2, 3 and 4 the conveying device 73 comprises a conveyor belt 22 and a feed worm that end at the input conveyor 21. In its longitudinal direction the feed worm 23 is positioned parallel to the conveyor belt 22, and is at a short distance from the input conveyor 21. The feed worm 23 is bearing mounted on the first frame 11 so as to be rotatable about its horizontal axis, wherein the diameter of the feed worm increases in the direction of the input conveyor 21. The feed worm 23 is provided with a circumferential worm or thread of a variable pitch, wherein the diameter of the worm or thread is adjusted to the diameter of the pots 15 to take them along in it according to a horizontal rectilinear input path T1 over the conveyor belt 22 and to the input conveyor 21.

The conveying device 73 comprises a discharge device that is not further shown, which delivers the pots 15 after discharge from the last output conveyor 41 according to a horizontal rectilinear output path T3.

As shown in FIG. 1 the conveying device 73 comprises a second frame 12, that is arranged straight below the first frame 11 and is able to shift vertically along a number of the vertical supports 8, wherein the height of the second frame 12 can be adjusted with respect to the first frame 11 by means of a height adjustment device 79. The conveying device 73 comprises ten slide assemblies 6, as shown in FIG. 5 each provided with a slide axis 64 bearing mounted to the second frame 12 and extending through the hollow shaft 60 of the respective transport wheel 5 and extending below and above it. At the upper side the slide assembly 6 is provided with a slide 61, in this example funnel-shaped, that is adapted for due to gravity receiving, passing through and discharging tablets from the dispensing module 33 positioned above the slide 61 according to a path as indicated with the arrow G. At the upper side the slide 61 comprises a first casting opening 65*a* straight below the counter 72 of the dispensing module 33 and at the lower side a second casting opening 65*b*, wherein the slide 61 is placed at an angle K to the axis of rotation S such that the second casting opening 65*b* is positioned all round straight above the circumferential edge 52 of the upper transport disc 50*a*. At the lower side the slide axis 64 is rotation-fixedly connected to a second toothed wheel 20.

As shown in FIG. 4 the conveying device 73 is provided with a second toothed belt 14 that alternately engages onto opposite sides of the second toothed wheels 20. At one outer end of the conveying device 73 the second toothed belt 14 is coupled to a slide drive unit 63 that is adapted for letting the first toothed belt 14 circulate, as a result of which the consecutive slides 61 acquire a third rotation direction L and an opposite fourth rotation direction M that are synchronised with each other. The slides 61 are synchronised such with respect to each other that all slides 61 have the same starting position and traverse the same distance with the lower side. Due to the various drives 62, 63 for the transport wheels 5 and the slides 61, respectively, the slides 61 are able to rotate independently with respect to the transport wheels 5.

The filling device 1 is provided with an electric control unit, which is not shown, having a control program for controlling the drives 62, 63 and the dispensing modules 33, in order to transport pots 15 and fill them with tablets.

FIGS. 6A-K show the process for filling the pots 15 with tablets, according to the filling device 1 shown in FIG. 1 with ten transit conveyors 31, 32 which per transport wheel 5 are provided with ten packaging holders 51. The conveyors 21, 31, 32, 41 driven by the first toothed belt 13 rotate according to rotation directions U and V wherein two consecutive conveyors 21, 31, 32, 41 rotate opposingly with respect to each other, in order to pass the pots 15 through according to the meandering guide path T2. FIGS. 6A-K show successive stages of a continuous process, that can be repeated infinitely.

By way of illustration in this example fifty pots 15 are standing by at the entry to be transported and filled by the filling device 1.

At the start of the continuous process the conveyor belt 22 and the transport wheel drive unit 62 are started and the pots 15 are supplied over the conveyor belt 22 to the input conveyor 21 that rotates in the second rotation direction V. FIG. 6A shows the situation in which three pots 15 have already been accommodated in three packaging holders 51 of the input conveyor 21, wherein the leading pot 15 is in the second rotation direction V one position before the first transfer position A. This is the notional starting point of the repetitive process.

Subsequently a predetermined series of five notional sub series of pots 15 is continuously entered at the first of the transfer positions A in the holders of the rotating transit conveyors 31, 32. The numbers of pots 15 within said sub series represent the number of pots 15 which, counted from the first of the transfer positions A, is entered in the holders of the rotating transit conveyors 31, 32. In this example it regards consecutively a first sub series of fourteen pots 15, a second sub series of nine pots 15, a third sub series of nine pots 15, a fourth sub series of nine pots 15 and a fifth sub series of nine pots 15. These sub series are notional as the process regards a continuous flow of pots 15, which is only divided into notional sub series for controlling the filling of pots 15 by means of the control unit. In FIG. 6B it is shown how according to the meandering guide path T2 the first sub series of fourteen pots 15 has been entered into the first three transit conveyors 31, 32 of the conveying device 73. After entry of said fourteen pots 15 three pots 15*a* are in the transfer positions A between successively the input conveyor 21 and the first transit conveyor 31, the first transit conveyor 31 and the second transit conveyor 32, the second transit conveyor 32 and the next first transit conveyor 31.

The instances shown in the separate box of FIG. 6B show half a rotary motion of one transit conveyor 31 in the first rotation direction U, following the situation as shown in FIG. 6B. It is visible how the slides 61, driven by the second toothed belt 14, during a filling time rotate a filling stroke along between a first slide position P and a second slide position Q rotation direction L or M that is the same as the rotation direction V or U, respectively, of the respective transport wheels 5, as a result of which the slide 61 with the casting opening 65 remains straight above the opening 67 of one onwardly moving pot 15*a* in order to follow it. From the moment the slide 61 is in the first slide position P above an empty pot 15*a* in a transfer position A, the counter 72 starts dispensing tablets. The counters 72 of the respective slides 61 under which no pots 15*a* are present yet, are inactive during the filling stroke. During the filling stroke the pot 15*a* is filled via the slide 61 with a counted quantity of tablets. The degree to which the pot 15*a* is filled with tablets is indicated in the separate box of FIG. 6B by means of black pie segments. As soon as the pot 15*a* is filled with the pre-determined quantity of tablets, wherein the full pot 15*a* is indicated by a fully black circular surface, the counter 72 ceases dispensing tablets and the slide drive 63 drives the second toothed belt 14 in opposite direction as a result of which the slide 61 rotates back to the first slide position P. Rotating back to the first slide position P ultimately takes place when the slide 61 has reached the second slide position Q above a transfer position A, but when filling the pots 15*a* is finished sooner, it can also take place sooner.

FIG. 6C shows how after the filling stroke of the slides 61 the pots 15*a* are filled and how the slides 61 at increased speed have returned to the first slide position P. The pots 15*a* are transported over half a stroke of the transport wheels 5 to the next upstream transfer position A of the transport wheel 5 that they are in. FIG. 6C also shows how during the filling stroke with respect to FIG. 6B five empty pots 15 of the second sub series of nine pots 15 have already been entered from the input conveyor 21 on the transit conveyors 31, 32. FIG. 6D shows how with respect to FIG. 6C the remaining four pots 15 of the second sub series of nine pots 15 have been entered. In total in FIG. 6D with respect to FIG. 6B the complete second sub series of nine pots 15 has been entered.

The number of pots 15 within this and each subsequent sub series is chosen such that after passing through the series in question all pots 15*a* passing into the transfer positions A are empty and ready for the filling stroke.

FIG. 6D shows the situation after entering the second sub series of nine pots 15, in which five empty pots 15*a* are in the transfer positions A. After the filling stroke, as shown in the separate box of FIG. 6B, said pots 15*a* are filled. In that case the five counters 72 of which the respective slides 61 are positioned above the five pots 15*a* are active. The result of this filling stroke is shown in FIG. 6E.

In FIG. 6E five pots 15 of the third sub series of nine pots 15 have been entered. In FIG. 6F the remaining four pots 15 of the third sub series of nine pots 15 have been entered and seven empty pots 15*a* are ready and present in the transfer positions A to be filled, wherein the seven pots 15*a* have subsequently been filled in FIG. 6G.

In FIG. 6G five pots 15 of the fourth sub series of nine pots 15 have been entered. In FIG. 6H the remaining four pots 15 of the fourth sub series of nine pots 15 have been entered and ten empty pots 15*a* are ready and present in the transfer positions A to be filled, wherein the ten pots 15*a* have subsequently been filled in FIG. 6I.

In FIG. 6I five pots 15 of the fifth sub series of nine pots 15 have been entered. In FIG. 6J the remaining four pots 15 of the fifth sub series of nine pots 15 have been entered and ten empty pots 15*a* are ready and present in the transfer positions A to be filled, wherein the ten pots 15*a* have subsequently been filled in FIG. 6K.

As from the last four transit conveyors 31, 32 during the steps shown in FIGS. 6A-K all pots 15 have been filled, after subsequently entering the sub series of fourteen, nine, nine, nine and nine pots 15 and the filling of the pots 15*a* within these continuously moving sub series. The first, second, third, fourth and fifth sub series together form a series, that can be repeated infinitely. In the process that is shown in the FIGS. 6A-K there is no repetition of the series, as a result of which the filling device 1 after passing through the fifty pots 15 empties. When repeating the process, that means repeatedly entering the series, there is a continuous flow of pots 15 through the filling device 1. The already filled pots 15*a* in the last transit conveyors 31, 32 as a result of said newly entered series are discharged via the output conveyors 41.

When the pots 15*a* are not completely filled at the second slide position Q, for instance due to a large quantity of bulk goods to be poured per pot 15*a*, the rotation speed of the transport wheels 5 and the swivelling speed of the slides 61 needs to be adjusted, so that the filling time becomes longer.

When programming the control unit the number of pots 15 in the consecutive sub series of the repetitive series are chosen such that the pots 15*a* in the transfer positions A after entering a sub series are empty and ready to be filled with tablets that are supplied by the slides 61. The numbers in the sub series depend on the number of transit conveyors 31, 32 and the number of packaging holders 51 of the transport wheels 5, wherein the dependency can be described on the basis of six conditions:

i) to all series applies that the number of sub series within the repetitive series is determined by dividing the number of packaging holders 51 of one transport wheel 5 by two.

ii) the overall number of pots 15 of the repetitive series equals the number of packaging holders 51 of one transport wheel 5 multiplied by the number of transit conveyors 31, 32 divided by two.

iii) if the number of sub series is an even number and if the number of transit conveyors 31, 32 is an even number, then the sub series each consist of a number of pots 15 equaling the overall number of pots 15 minus the number of sub series within the series divided by the number of sub series within the series, wherein a number of packagings equaling the number of sub series within the repetitive series is added to the first sub series of the series.

iv) if the number of sub series is an odd number and if the resulting number of a division of the number of transit conveyors 31, 32 by the number of sub series within the series results in an integer, the sub series each consist of a number of pots 15 equaling the overall number of pots 15 minus the number of sub series within the repetitive series, overall divided by the number of sub series within the repetitive series, wherein a number of packagings equaling the number of sub series within the series is added to the first sub series of the series. That is why in the example above there is question of a repetitive series consisting of five sub series of fourteen, nine, nine, nine and nine pots 15, respectively.

v) in all other cases with an even number of packaging holders 51 the sub series each consist of a number of pots 15 equaling the overall number of pots 15 of the repetitive series divided by the number of sub series within the series.

FIGS. 7A and 7B show an alternative conveyor, comprising a first bearing housing 158 that is fixedly connected to the first frame 11, a hollow shaft 160 bearing mounted within the bearing housing 158 and having a vertical centre line and axis of rotation S, a toothed wheel 159 that is rotation-fixedly connected to the hollow shaft 160 at the lower side of the first bearing housing 158 and an electromagnetic transport wheel support 156 that is rotation-fixedly connected to the hollow shaft 160 at the upper side of the first bearing housing 158. The alternative conveyor comprises a transport wheel 105 that is provided with a transport disc 150 and a substantially circular bottom disc 153. At the side facing away from the transport disc 150 the bottom disc 153 is provided with a circular cavity 154, with which the bottom disc 153 can be electromagnetically connected to an electromagnetic transport wheel support 156. The cavity 154 and the electromagnetic transport wheel support 156 are provided with a first index surface 155 and a second index surface 157, respectively, that together form an index for unambiguous attachment of the transport wheel 5 to the electromagnetic transport wheel support 156 for synchronisation. Due to the electromagnetic forces the transport wheel 5 is immediately locked after placement. The transport disc 150 and the bottom disc 153 are integrally manufactured.

The above description is included to illustrate the operation of preferred embodiments of the invention and not to limit the scope of the invention. Starting from the above explanation many variations that fall within the spirit and scope of the present invention will be evident to an expert.

The invention claimed is:

1. A filling device for filling packagings with counted bulk goods, comprising a dispenser having several dispensing units provided with a counter for counted dispensation of the bulk goods to the packagings and a conveying device for transport of the packagings with respect to the dispensing units, wherein the conveying device is provided with several consecutive transport wheels and a transport wheel drive for mutual opposite rotation of the immediately consecutive transport wheels, wherein the transport wheels each have a first axis of rotation and several packaging holders spread around the circumference of the transport wheel, wherein the transport wheels are positioned in each other's vicinity at the location of the packaging holders and with the axes of rotation parallel to each other for the transfer of packagings between packaging holders at a mutual transfer position between the immediately consecutive transport wheels during the opposite rotation for obtaining a meandering conveyance path of the packagings with respect to the dispensing units, which path is constituted of opposite arch segments, wherein the conveying device is provided above at least a part of the transport wheels with a slide per transport wheel, which slide is positioned at a slant and has a second axis of rotation and a lower exit for the transfer of counted bulk goods from the dispensing units to the packagings, wherein the conveying device comprises a slide drive for mutual opposite rotation of the immediately consecutive slides in accordance with the transport wheels, such that the lower exit follows a packaging moving away from the transfer position, which packaging is in the packaging holder of said transport wheel.

2. The filling device according to claim 1, wherein consecutive transfer positions between consecutive transport wheels are situated on a first straight line.

3. The filling device according to claim 2, wherein the first axes axis of rotation of each consecutive transport wheel is situated on a second straight line.

4. The filling device according to claim 3, wherein the first line and the second line coincide with each other.

5. The filling device according to claim 1, wherein the first axes of rotation are substantially vertically oriented and the meandering conveyance path extends in a substantially horizontal straight plane.

6. The filling device according to claim 1, wherein the packaging holders coming together at the transfer position enclose a packaging on both sides.

7. The filling device according to claim 1, wherein the transport wheels have an outer circumference situated on a circle at which outer circumference the packaging holders are situated.

8. The filling device according to claim 1, wherein the transport wheels are detachably magnetically connected to or magnetically locked with respect to the transport wheel drive.

9. The filling device according to claim 8, wherein the transport wheel drive comprises a transport wheel support having an electromagnet that can be switched on and off for connecting or locking the transport wheels with respect to the transport wheel drive.

10. The filling device according to claim 1, wherein the transport wheel drive is adapted for synchronized opposite rotation of the immediately consecutive transport wheels at the same speed of revolution and per revolution with the same packaging holders at the transfer position.

11. The filling device according to claim 1, wherein the first and second axes of rotation coincide with each other.

12. The filling device according to claim 1, wherein the slide drive is adapted for synchronized opposite rotation of the immediately consecutive slides in accordance with the transport wheels at the same speed of revolution and with the same starting position with respect to the transfer position.

13. The filling device according to claim 1, wherein the height of the lower exit of the slide is adjustable with respect to the packaging holders.

14. The filling device according to claim 1, wherein the conveying device at the location of one or several last transport wheels is provided with a separation device for removing disapproved packagings from the meandering path.

* * * * *